US005374064A

United States Patent [19]

Barber

[11] Patent Number: 5,374,064

[45] Date of Patent: Dec. 20, 1994

[54] GOLF CLUB TRAINING APPARATUS

[76] Inventor: Frederick E. Barber, 24801 Carlysle, Dearborn, Mich. 48124

[21] Appl. No.: 96,299

[22] Filed: Jul. 26, 1993

[51] Int. Cl.[5] ..... A63B 69/36

[52] U.S. Cl. ..... 273/194 R; 273/81.2; 273/81.3; 273/77 A

[58] Field of Search ..... 273/81.2, 81.3, 165, 273/81 D, 193 R, 194 R, 193 B, 187.4, 187.5, 77 A

[56] References Cited

U.S. PATENT DOCUMENTS

| | | | |
|---|---|---|---|
| 727,086 | 5/1903 | Burnam | 273/81.2 |
| 1,201,728 | 10/1916 | Henry et al. | 273/81.3 |
| 2,949,304 | 8/1960 | Williams | 273/81.2 X |
| 3,533,630 | 10/1970 | Monaco | 273/81.2 X |
| 4,269,412 | 5/1981 | Hughes | 273/81.3 |

*Primary Examiner*—George J. Marlo

[57] ABSTRACT

A new and improved golf club training apparatus includes a head assembly which includes a planar, ball-hitting surface. The planar, ball-hitting surface lies in a first plane. A shaft assembly is connected to the head assembly. The head assembly and the shaft assembly are oriented with respect to each other along a first longitudinal axis, and a first handle grip assembly is connected to the shaft assembly. The first handle grip assembly includes a first handle portion connected to the shaft assembly along the first longitudinal axis. The first handle grip assembly also includes a second handle portion connected to the first handle portion at a acute angle of approximately thirty degrees with respect to the first longitudinal axis passing through the first handle portion. The first handle portion and the second handle portion lie in a common second plane. The first handle grip assembly is capable of being selectively oriented around the first longitudinal axis such that a relative angular orientation between the first handle grip assembly in the second plane can be selectively adjusted with respect to the planar, ball-hitting surface of the head assembly in the first plane. A second handle grip assembly is straight and includes a longitudinal axis which is co-axial with the first longitudinal axis. The angled first handle grip assembly and the straight second handle grip assembly are interchangeable. A lock assembly is used for locking the first handle grip assembly or the second handle grip assembly onto the shaft assembly.

5 Claims, 3 Drawing Sheets

GOLF CLUB TRAINING APPARATUS

BACKGROUND OF THE INVENTION

1. Field of the Invention

The present invention relates generally to the sport of golf, and, more particularly, to training devices especially adapted for improving a golfer's swing of a golf club.

2. Description of the Prior Art

Golf is a popular sport in which golf clubs are a key component. A golf club generally includes a grip, a shaft, and a head. Throughout the years many innovations have been made in each of the three major components of the club. Of specific interest with respect to the present invention are innovations relating to the grip portions of the club. More specifically, the following U.S. patents are representative of some of those innovations relating to golf club grips: U.S. Pat. Nos. 4,116,440; 4,524,973; 4,878,667; 4,974,846; 4,988,102; and 5,037,103.

More specifically, U.S. Pat. No. 4,116,440 discloses a golf club grip that is generally cylindrical in shape. A number of arcuate surfaces are provided for receiving the heel of the thumb of the other fingers. U.S. Pat. No. 4,524,973 discloses a grip-correcting golf club handle that includes interior components such as springs for shifting a gripping force from one location on the handle grip to another location on the handle grip. U.S. Pat. No. 4,878,667 discloses a replaceable and reusable golf club grip. U.S. Pat. No. 4,974,846 discloses a golf club grip that includes a unique arrangement of grooves on the handle. U.S. Pat. No. 4,988,102 discloses a weighted golf club grip. U.S. Pat. No. 5,037,103 discloses a golf club having a two-part handle, each part being gripping by only one hand independent of the other hand.

Although the above-mentioned patents disclose devices that have many differences from each other, they do, however, share a common characteristic: the longitudinal axis of the golf club shaft is substantially parallel to the longitudinal axis of the club handle. For a number of reasons, explained below, it would be desirable if a golf club were provided in which the longitudinal axis of the shaft and the longitudinal axis of the club handle are not parallel.

Still other features would be desirable in a golf club training apparatus. As mentioned above a golf club includes a handle grip, a shaft, and a head. With prior art training devices, when a special handle grip is provided, the entire club is special. That is, the shaft and the head are inseparable from the handle grip and go along with the handle grip. However, since only the handle grip portion of a training club may be unconventional, and the shaft and head portions may be conventional, it would be desirable if a golf club training apparatus were provided which permitted an unconventional handle grip to be exchanged for a conventional handle grip so as to keep the conventional shaft and head.

For an unconventional golf club that has two interchangeable handle grips for a common shaft, an important characteristic of the connection between the interchangeable handle grips and the shaft is a connection that does not permit rotation of one handle grip or the other around the longitudinal axis extending through the shaft.

For a non-rotatable connection between the handle grip portions and the shaft, a preferred arrangement between the handle grip and the shaft is a complementary spline and groove arrangement. In this respect, it would be desirable if a device were provided for training in the use of a golf club which includes a complementary spline and groove arrangement between the handle grip and the shaft.

When people use training devices, it often requires a considerable amount of concentration and body control to execute body movements that are beneficial to good achievement and that achieve good body control. However, it would be desirable if a golf club training apparatus were provided that, by its very nature, facilitated appropriate body movements conducive to desirable body motion during a swing of a golf club.

With a conventional golf club, which has the handle grip and the shaft aligned along a common longitudinal axis, the orientation of the head when it strikes the ball is determined primarily by the orientation of the head with respect to the longitudinal axis of the shaft. This conventional arrangement is cause of much inconsistency in a golfer's swing. More specifically, the golfer may find it difficult to consistently orient the club's head with respect to the handle grip when the golfer grasps the handle grip. In this respect, it would be desirable if a training device for using a golf club were provided which facilitates a consistent orientation of the head of the club with respect to the handle grip when the user grasps the handle grip.

Thus, while the foregoing body of prior art indicates it to be well known to use a variety of training aids for the sport of golf, the prior art described above does not teach or suggest a golf club training apparatus which has the following combination of desirable features: (1) the longitudinal axis of the shaft and the longitudinal axis of the club handle are not parallel; (2) permits an unconventional handle grip to be exchanged for a conventional handle grip to retain the conventional shaft and head; (3) provides a connection between the interchangeable handle grips and the shaft which does not permit rotation of a handle grip around the longitudinal axis that extends through the shaft; (4) provides a golf club which includes a complementary spline and groove arrangement between the handle grip and the shaft; (5) facilitates appropriate body movements conducive to desirable body motion during a swing of a golf club; and (6) facilitates a consistent orientation of the head of the club with respect to the handle grip when the user grasps the handle grip. The foregoing desired characteristics are provided by the unique golf club training apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved golf club training apparatus which includes a head assembly which includes a planar, ball-hitting surface and a connecting portion for connecting the head assembly to a shaft assembly. The planar, ball-hitting surface lies in a first plane. A shaft assembly is connected to the head assembly. The head assembly and the shaft assembly are oriented with respect to each other along a first longitudinal axis, and a first handle grip assembly is connected to the shaft assembly. The first handle grip assembly includes a first handle portion connected to the shaft assembly along the first longitudinal axis. The first handle grip assembly also includes a second handle portion connected to the first handle portion at a acute angle with respect to the first longitudinal axis passing through the first handle portion. The first handle portion and the second handle portion lie in a common second plane.

The acute angle is approximately thirty degrees. The first handle grip assembly lies in the second plane and is capable of being selectively oriented around the first longitudinal -axis such that a relative angular orientation between the first handle grip assembly in the second plane can be selectively adjusted with respect to the planar, ball-hitting surface of the head assembly in the first plane. The first handle grip assembly is connected to the shaft assembly by a spline and groove arrangement, wherein the grooves are located in the first handle grip assembly, and the splines are located in the shaft assembly.

A second handle grip assembly is straight and includes a third longitudinal axis. The third longitudinal axis is co-axial with the first longitudinal axis. The first handle grip assembly and the second handle grip assembly are interchangeable.

A lock assembly is used for locking the first handle grip assembly or the second handle grip assembly onto the shaft assembly. The lock assembly includes a first threaded portion located on the shaft assembly. A locking sleeve is supported by the first handle grip assembly or the second handle grip assembly. The locking sleeve includes a second threaded portion which is complementary to the first threaded portion. The locking sleeve also includes a lip portion for engaging a complementary flange portion located on the first handle grip assembly or the second handle grip assembly, such that, when the locking sleeve is screwed onto the first threaded portion, the lip portion of the locking sleeve engages the flange portion of the first handle grip assembly or the second handle grip assembly, whereby the first handle grip assembly or the second handle grip assembly is securely attached to the shaft assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved golf club training apparatus which has all of the advantages of the prior art and none of the disadvantages.

It is another object of the present invention to provide a new and improved golf club training apparatus which may be easily and efficiently manufactured and marketed.

It is a further object of the present invention to provide a new and improved golf club training apparatus which is of durable and reliable construction.

An even further object of the present invention is to provide a new and improved golf club training apparatus which is susceptible of a low cost of manufacture with regard to both materials and labor, and which accordingly is then susceptible of low prices of sale to the consuming public, thereby making such golf club training apparatus available to the buying public.

Still yet a further object of the present invention is to provide a new and improved golf club training apparatus in which the longitudinal axis of the shaft and the longitudinal axis of the club handle are not parallel.

Still another object of the present invention is to provide a new and improved golf club training apparatus that permits an unconventional handle grip to be exchanged for a conventional handle grip to retain the conventional shaft and head.

Yet another object of the present invention is to provide a new and improved golf club training apparatus which provides a connection between the interchangeable handle grips and the shaft which does not permit rotation of a handle grip around the longitudinal axis that extends through the shaft.

Even another object of the present invention is to provide a new and improved golf club training apparatus that provides a golf club which includes a complementary spline and groove arrangement between the handle grip and the shaft.

Still a further object of the present invention is to provide a new and improved golf club training apparatus which facilitates appropriate body movements conducive to desirable body motion during a swing of a golf club.

Yet another object of the present invention is to provide a new and improved golf club training apparatus that facilitates a consistent orientation of the head of the club with respect to the handle grip when the user grasps the handle grip.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved golf club training apparatus embodying the principles and concepts of the present invention will be described.

Figure 1:
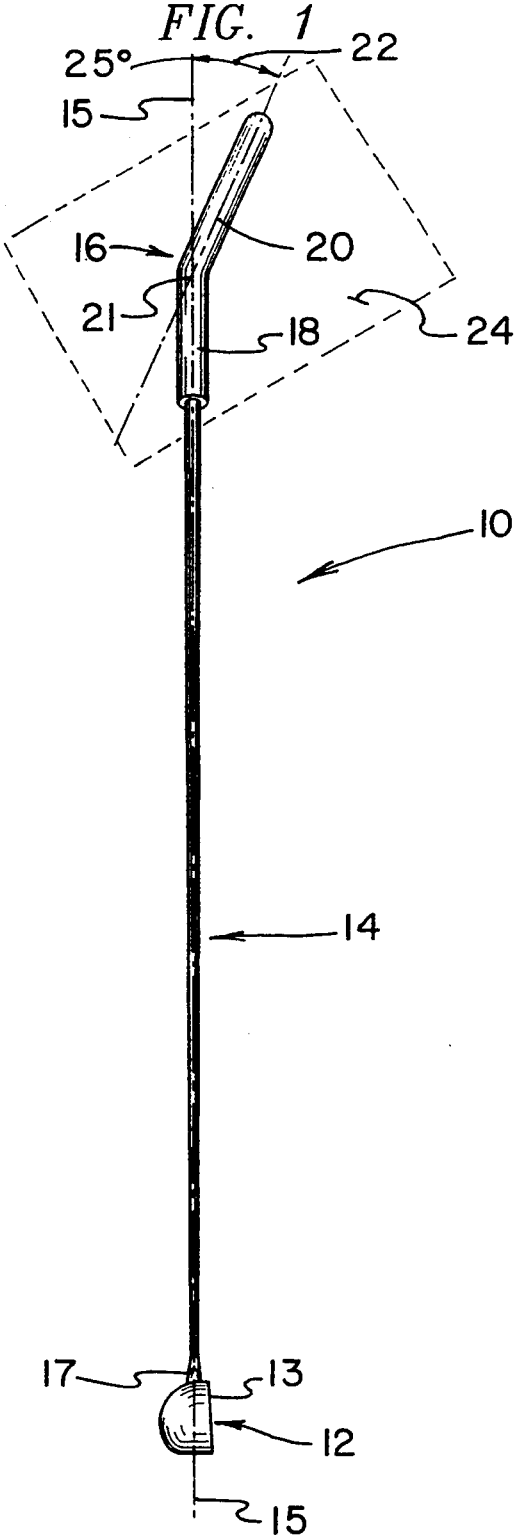
FIG. 1 is a front view showing a first preferred embodiment of the golf club training apparatus of the invention which includes a handle grip oriented at an obtuse angle with respect to the longitudinal axis of the club shaft.
Figure 2:
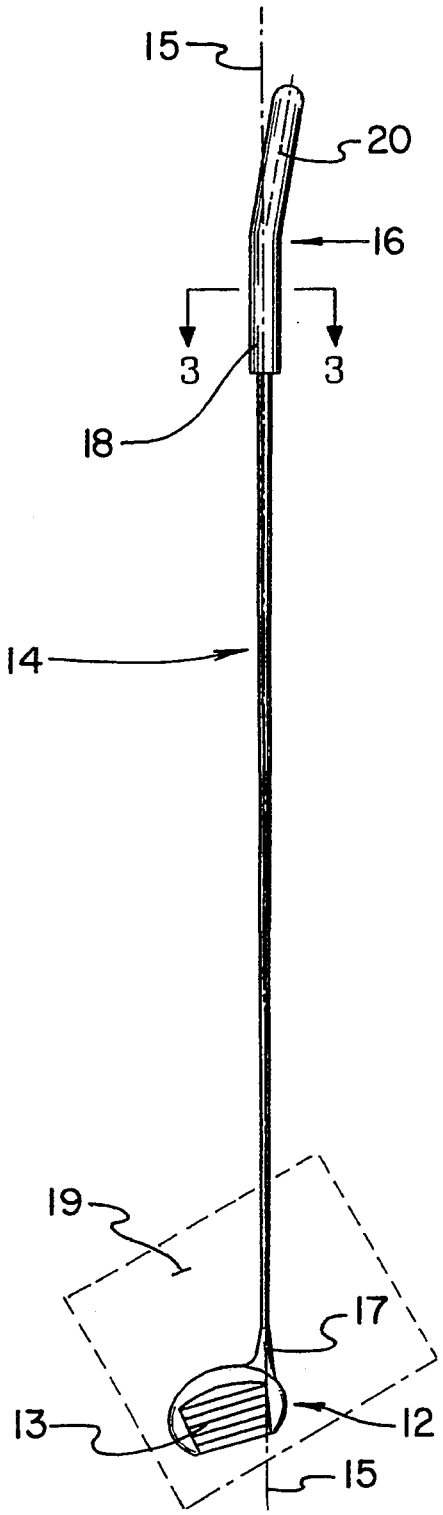
FIG. 2 is a side view of the golf club training apparatus shown in FIG. 1, wherein the club has been rotated clockwise 90 degrees from the view shown in FIG. 1.
Figure 3:
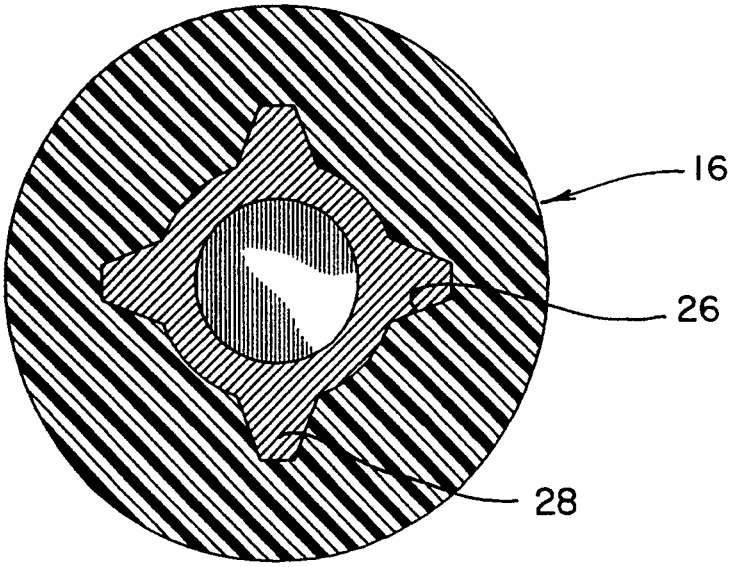
FIG. 3 is an enlarged cross-sectional view of the golf club training apparatus of FIG. 2 taken along line 3—3 thereof.

Turning initially to FIGS. 1–3, there is shown a first exemplary embodiment of the golf club training apparatus of the invention generally designated by reference numeral 10. In its preferred form, golf club training apparatus 10 includes a head assembly 12 which includes a planar, ball-hitting surface 13 and a connecting portion 17 for connecting the head assembly 12 to a shaft assembly 14. The planar, ball-hitting surface 13 lies in a first plane 19. A shaft assembly 14 is connected to the head assembly 12. The head assembly 12 and the shaft assembly 14 are oriented with respect to each other along a first longitudinal axis 15, and a first handle grip assembly 16 is connected to the shaft assembly 14. The first handle grip assembly 16 includes a first handle portion 18 connected to the shaft assembly 14 along the first longitudinal axis 15. The first handle grip assembly 16 also includes a second handle portion 20 connected to the first handle portion 18 at a acute angle 22 with respect to the first longitudinal axis 15 passing through the first handle portion 18. The first handle portion 18 and the second handle portion 20 lie in a common second plane 24.

The acute angle 22 is approximately thirty degrees. The first handle grip assembly 16 lies in the second plane 24 and is capable of being selectively oriented around the first longitudinal axis 15 such that a relative angular orientation between the first handle grip assembly 16 in the second plane 24 can be selectively adjusted with respect to the planar, ball-hitting surface 13 of the head assembly 12 in the first plane 19.

As shown in FIGS. 1 and 2, the second plane 24 is not parallel to the first plane 19. The angular relation between the second plane 24 and the first plane 19 is determined by the selected rotational position of the second handle portion 20 around the first longitudinal axis 15. The first handle grip assembly 16 is connected to the shaft assembly 14 by a spline and groove arrangement, wherein the grooves 26 are located in the first handle grip assembly 16, and the splines 28 are located in the shaft assembly 14. By removing the first handle grip assembly 16 from the shaft assembly 14, by rotating the first handle grip assembly 16 around the first longitudinal axis 15 to reposition the grooves 26, and by replacing the first handle grip assembly 16 on the splines 28 of the shaft assembly 14, the relative angular orientation between the first handle grip assembly 16 in the second plane 24 can be selectively adjusted with respect to the planar, ball-hitting surface 13 of the head assembly 12 in the first plane 19.

As shown in FIG. 3, the splines 28 fit into the grooves 26 by a tight friction fit.

Figure 4:
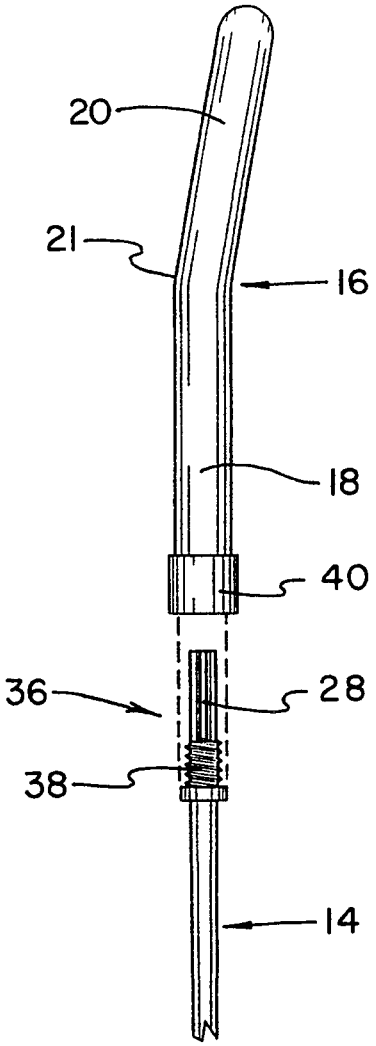
FIG. 4 is an exploded, partial side view of a second preferred embodiment of the invention, wherein an angled handle grip can be removed and replaced with an straight handle grip.
Figure 5:
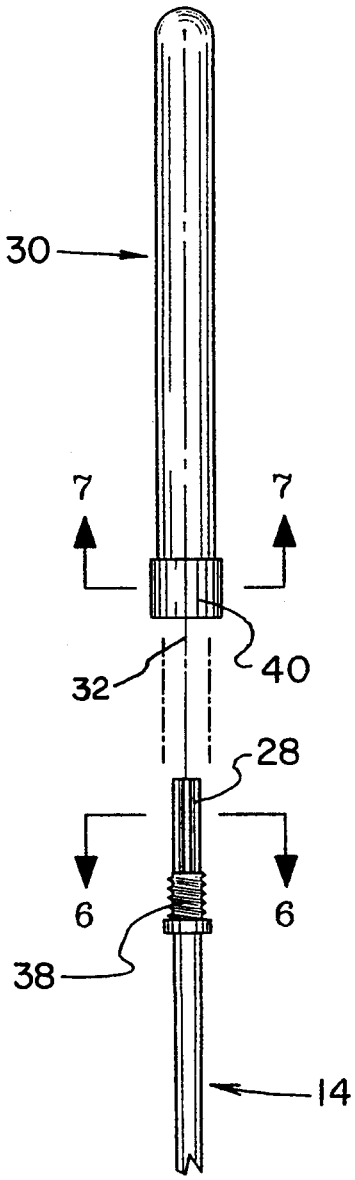
FIG. 5 is an exploded, partial side view of the embodiment shown in FIG. 4 wherein the angled handle grip has been removed and is about to be replaced with a straight handle grip.
Figure 6:
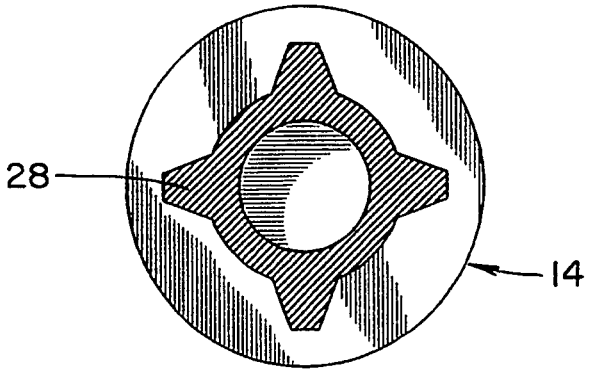
FIG. 6 is an enlarged cross-sectional view of the embodiment of the invention shown in FIG. 5 taken along the line 6—6 thereof.
Figure 7:
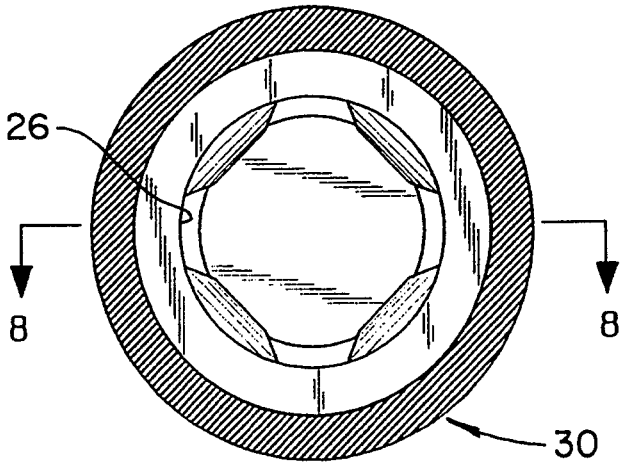
FIG. 7 is an enlarged cross-sectional view of the embodiment of the invention shown in FIG. 5 taken along the line 7—7 thereof.
Figure 8:
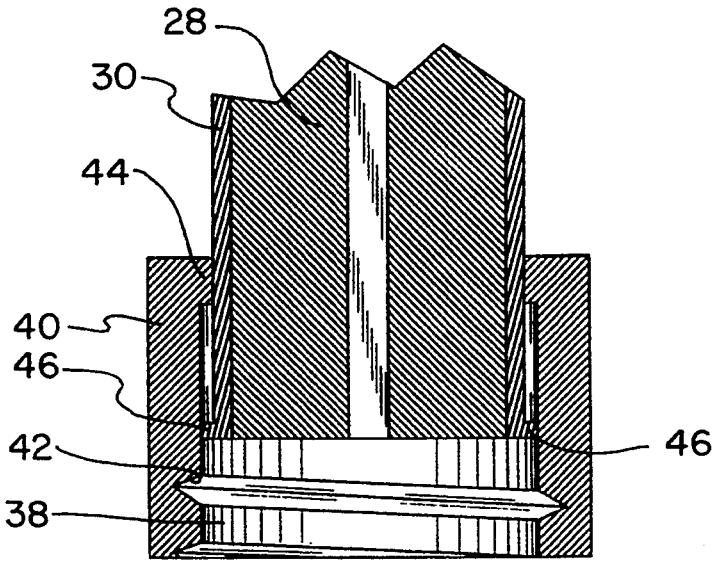
FIG. 8 is a cross-sectional view of the embodiment shown in FIG. 7 taken along the line 8—8 thereof.

As shown in FIG. 4, a lock assembly 36 is used for locking the first handle grip assembly 16 or the second handle grip assembly 30 onto the shaft assembly 14. The lock assembly 36 includes a first threaded portion 38 located on the shaft assembly 14. A locking sleeve 40 is supported by the first handle grip assembly 16 or the second handle grip assembly 30. The locking sleeve 40 includes a second threaded portion 42 (see FIG. 8) which is complementary to the first threaded portion 38. The locking sleeve 40 also includes a lip portion 44 for engaging a complementary flange portion 46 located on the first handle grip assembly 16 or the second handle grip assembly 30, such that, when the locking sleeve 40 is screwed onto the first threaded portion 38, the lip portion 44 of the locking sleeve 40 engages the flange portion 46 of the first handle grip assembly 16 (or the second handle grip assembly 30 as shown in FIG. 5), whereby the first handle grip assembly 16 or the second handle grip assembly 30 (as shown in FIG. 5) is securely attached to the shaft assembly 14. It is clear that the structures for connecting and locking either the first handle grip assembly 16 (which is angled) or the second handle grip assembly 30 (which is straight) are identical. This provides for the interchangeability between the angled and the straight handle grip portions.

Turning to FIGS. 5–8, a second embodiment of the invention is shown. Reference numerals are shown that correspond to like reference numerals that designate like elements shown in the other figures. In addition, a second handle grip assembly 30 is straight and includes a third longitudinal axis 32. The third longitudinal axis 32 is co-axial with the first longitudinal axis 15. As stated above, the angled first handle grip assembly 16 and the straight second handle grip assembly 30 are interchangeable.

With the invention, the angularity of the first handle grip assembly 16 is useful in training a golfer to swing a club properly. The acute angle 22 between the first handle portion 18 and the second handle portion 20 of the first handle grip assembly 16 automatically forces a person to perform proper swinging technique. More specifically, the position of the golfer's hands on a upward swing force the golfer to automatically tuck his elbow and bend his legs with proper body motion, resulting in more body power applied to hitting the golf ball. More specifically, by having the acute angle 22 (which is between the first longitudinal axis 15 through the first handle portion 18 and the second handle portion 20 of the first handle grip assembly 16) at an angle of approximately 30 degrees, when the club is held, the front hand is positioned so that it will cross in front of the golfer's body, forcing a knee to bend, causing the hips to twist, and automatically forcing an elbow to tuck. The golf club training apparatus of the invention can help any golfer to improve the pendulum stroke and can help beginning golfers to practice proper swinging technique.

One way to hold the first handle grip assembly 16 of the invention is to have the left hand of the golfer positioned on the second handle portion 20 and to have the heel of the right hand positioned at the angular bend 21 has acute angle 22. When holding the club, the left hand palm will be inside with the back of the hand facing outward, whereby the elbow is forced to tuck for proper stroke. This automatically forces the golfer to bend a knee and torque his hips for proper technique. More specifically, by employing the golf club training apparatus of the invention, the positioning of the hands of the handle grip forces the body to assume proper positioning during a club swing.

Although numerous manufacturing methods may be employed to produce the golf club training apparatus of the invention, the following particular method may be employed. In this method, the shaft assembly 14 and the first handle grip assembly 16 are made as one unified structure. A coil of high alloy steel flat strip is fed into a series of roll form dies to produce a tube which will be 1 inch in diameter with a wall thickness of 0.058 inches. The tube is fused together by high frequency welding and cut to 18 inch lengths. The tubes are prepared for drawing through roll dies of different diameter and are then reduced in size by giant presses such as conventionally used in the tubing industry. As the tubes are drawn through the smaller roll dies, they are reduced in size at the same time a mandrel is used on the inside of the tube to achieve the specified outside and inside diameter. The tube is subjected to a bending operation so that the acute angle 22 between the first longitudinal axis 15 through the first handle portion 18 and the second handle portion 20 is approximately 25 degrees. The bending operation can be achieved by a series of draw dies to accomplish the 25 degrees bend. After bending of the handle, it is then heat treated or austempered. The shaft is placed in a heat treating furnace and is controlled at a temperature of 1600 degrees F.. The shaft is then placed in a molten salt quench bath for proper hardness and strength. At this step of the process, a fixture is used to hold the bent shaft for a spinning and strengthening operation. This allows the shaft to be spun on a computer-controlled machine and inspected for straightness. After the shafts are polished, they are subjected to several acid and water baths to remove any impurities. The shafts are then electrolytically plated with nickel and then are finished and chrome plated. Another fixture is also used for final assembly of the combined shaft and first handle grip assembly of the invention so that an exact placement of the head assembly with respect to the shaft will be at a specified angle, e.g. 10 degrees, when completed. Also, in the last operation of assembly of the head and the shaft, the whipping operation is either done manually, or, by using another fixture, for holding the shaft on a whipping machine.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved golf club training apparatus that is low in cost, relatively simple in design and operation, and which may advantageously be used to provide a golf club in which the longitudinal axis of the shaft and the longitudinal axis of the club handle are not parallel. With the invention, a golf club training apparatus is provided which permits an unconventional handle grip to be exchanged for a conventional handle grip to retain the conventional shaft and head. With the invention, a golf club training apparatus is provided which provides a connection between the interchangeable handle grips and the shaft which does not permit rotation of a handle grip around the longitudinal axis that extends through the shaft. With the invention, a golf club training apparatus is provided which provides a golf club which includes a complementary spline and groove arrangement between the handle grip and the shaft. With the invention, a golf club training apparatus is provided which facilitates appropriate body movements conducive to desirable body motion during a swing of a golf club. With the invention, a golf club training apparatus is provided which facilitates a consistent orientation of the head of the club with respect to the handle grip when the user grasps the handle grip.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A new and improved golf club training apparatus, comprising:

a head assembly which includes a planar, ball-hitting surface and a connecting portion for connecting said head assembly to a shaft assembly, said planar, ball-hitting surface lying in a first plane, a shaft assembly connected to said head assembly, said head assembly and said shaft assembly oriented with respect to each other along a first longitudinal axis, and a first and second handle grip assembly each adapted to be detachably locked to said shaft assembly, said first handle grip assembly including a first handle portion adapted to be connected to said shaft assembly along said first longitudinal axis, said first handle grip assembly also including a second handle portion connected to said first handle portion at a acute angle of approximately thirty degrees with respect to said first longitudinal axis passing through said first handle portion, said first handle portion and said second handle portion lying in a common second plane, said first handle grip assembly being capable of being selectively oriented around said first longitudinal axis such that a relative angular orientation of said first handle grip assembly in said second plane can be selectively adjusted with respect to said planar, ball-hitting surface of said head assembly in said first plane, said second handle grip assembly being adapted to be selectively connected to said shaft assembly in place of said first handle grip assembly, said second handle grip assembly being straight and including a longitudinal axis which is coaxial with said first longitudinal axis when connected to said shaft assembly.

2. The apparatus described in claim 1 wherein said first and second handle grip assembly are connected to said shaft assembly by a spline and groove arrangement.

3. The apparatus described in claim 1 wherein:

grooves are located in said first and second handle grip assembly, and splines are located in said shaft assembly.

4. The apparatus described in claim 1, further including:

a lock assembly for locking said first handle grip assembly and said second handle grip assembly onto said shaft assembly.

5. The apparatus described in claim 4 wherein said lock assembly includes:

a first threaded portion located on said shaft assembly, and a locking sleeve supported by said first handle grip assembly and said second handle grip assembly, said locking sleeve including a second threaded portion which is complementary to said first threaded portion, said locking sleeve also including a lip portion for engaging .a complementary flange portion located on said first handle grip assembly and said second handle grip assembly, such that, when said locking sleeve is screwed onto said first threaded portion, and said lip portion of said locking sleeve engages said flange portion of said first handle grip assembly or said second handle grip assembly, whereby said first handle grip assembly or said second handle grip assembly is securely attached to said shaft assembly.

* * * * *